United States Patent [19]

Ball

[11] Patent Number: 4,508,407

[45] Date of Patent: Apr. 2, 1985

[54] SELF-LOCKING CONNECTOR

[75] Inventor: David J. Ball, Encino, Calif.

[73] Assignee: International Telephone & Telegraph Corporation, New York, N.Y.

[21] Appl. No.: 446,120

[22] Filed: Dec. 2, 1982

[51] Int. Cl.[3] ..... H01R 13/54

[52] U.S. Cl. ..... 339/89 R; 339/89 M; 339/91 B

[58] Field of Search ..... 339/89 R, 89 C, 89 M, 339/90 R, 90 C, DIG. 2, 91 B; 285/81, 82

[56] References Cited

U.S. PATENT DOCUMENTS

| | | | |
|---|---|---|---|
| 3,611,260 | 10/1971 | Colardeau | 339/89 |
| 3,669,472 | 6/1972 | Nadsady | 339/89 R X |
| 3,808,580 | 4/1974 | Vohnson | 339/89 R |
| 3,964,771 | 6/1976 | Bandonin | 339/91 B |
| 4,165,910 | 8/1979 | Anderson | 339/89 |
| 4,183,605 | 1/1980 | Arneson | 339/89 M |
| 4,290,662 | 9/1981 | Storcel | 339/89 |
| 4,291,933 | 9/1981 | Kakaris | 339/89 R |

*Primary Examiner*—William R. Briggs
*Attorney, Agent, or Firm*—T. L. Peterson

[57] ABSTRACT

A self-locking connector in which balls carried by a connector shell are spring biased toward a locking ring which is rotatable with the coupling nut of the connector. The ring is formed with a circular array of detent recesses with which the balls engage when the coupling nut is rotated. The balls and recesses are arranged so that only one ball engages a recess at any instant so that there are a large number of locking positions for the coupling nut.

8 Claims, 5 Drawing Figures

SELF-LOCKING CONNECTOR

BACKGROUND OF THE INVENTION

The present invention relates generally to a connector and, more particularly, to a self-locking connector of the type in which a detent locking arrangement is provided between the coupling nut and the shell of one of the mating connector members of the connector.

While the present invention will be described specifically herein with connection with an electrical connector, it will be appreciated that the invention could also be applied to fiber optic connectors as well as other coupling arrangements such as those utilized for interconnecting fluid conduits or the like.

Electrical connectors used in high vibration environments, such as in an aircraft, may decouple, or demate, during use. This is particularly a problem in cylindrical type connectors which utilize threaded coupling nuts to maintain the connection between the plug and receptacle members of the connector. It is known in the art to provide a detent type self-locking coupling mechanism for the connector, which is operatively connected between the coupling nut on the plug connector member and the shell of either the plug or receptacle connector member. The detent locking mechanism may include balls mounted on a flange of the plug shell or projections or dimples stamped in a detent ring which is affixed to the shell. The locking mechanism may also include a locking ring which is rotatable with the coupling nut of the connector. The ring typically is formed with a circular array of holes or recesses which face in the direction of the balls. Typically the number of recesses exceeds the number of balls in the locking mechanism. Spring means is normally provided urging the balls into engagement with the locking ring so that the balls will snap into the recesses as the coupling nut is rotated. In some cases the detent projections are provided on resilient spring arms formed on an annular ring which is carried by the plug shell. The parts may be reversed so that the detent balls or projections are carried by the coupling nut and the locking ring is affixed to the shell. In a further arrangement, the detent recesses may be provided on the receptacle shell. The following United States patents disclose self-locking connectors of the type described above: U.S. Pat. Nos. 2,152,977; 3,462,727; 3,552,777; 3,669,472; 3,786,396; 3,808,580; 3,920,269; and 4,291,933.

In the prior art locking mechanisms of the type referred to above the balls or projections engage the detent recesses in the locking ring in unison. Typically, the number of balls and recesses are equal, or the number of recesses is greater than the number of balls and divisible by the number of balls. For example, it is typical to provide three locking balls in the locking mechanism and twelve detent recesses in the locking ring. Such an arrangement provides a locking or detenting action at intervals of 30° of rotation of the coupling nut. When a coupling mechanism of this type is utilized with a connector having a single-start coupling thread embodying, for example, twenty-eight to sixteen threads per inch, the 30° incremental locking steps provide the desired locking action. However, a finer angular articulation is required to properly lock rapid coupling thread systems such as a multistart Acme thread utilized on some electrical connectors. In one such coupling arrangement, a triple-start thread having a lead of 0.300 inches is required. In this case, use of 30° locking intervals would result in an axial coupling motion of 0.025 inches per locking point, which would be too coarse to properly lock the coupling mechanism.

Thus, what is required and constitutes the object of the present invention is to provide a self-locking coupling mechanism for a connector in which the locking or detent action occurs at shorter angular intervals of rotation of the coupling nut.

SUMMARY OF THE INVENTION

According to a principal aspect of the present invention, there is provided a self-locking coupling mechanism for a connector in which the locking projections and the detent recesses on the locking ring are arranged whereby only one projection may engage a recess at any instant so that there are a large number of locking positions and, consequently, a finer angular articulation is achieved to properly lock a rapid coupling thread system for a connector. It will be appreciated, however, that the locking arrangement of the invention could be utilized with coupling nuts having a relatively fine thread rather than a coarse thread. In a preferred embodiment of the invention the number of detent recesses is indivisible by the number of locking projections.

DESCRIPTION OF THE PREFERRED EMBODIMENTS

Figure 1:
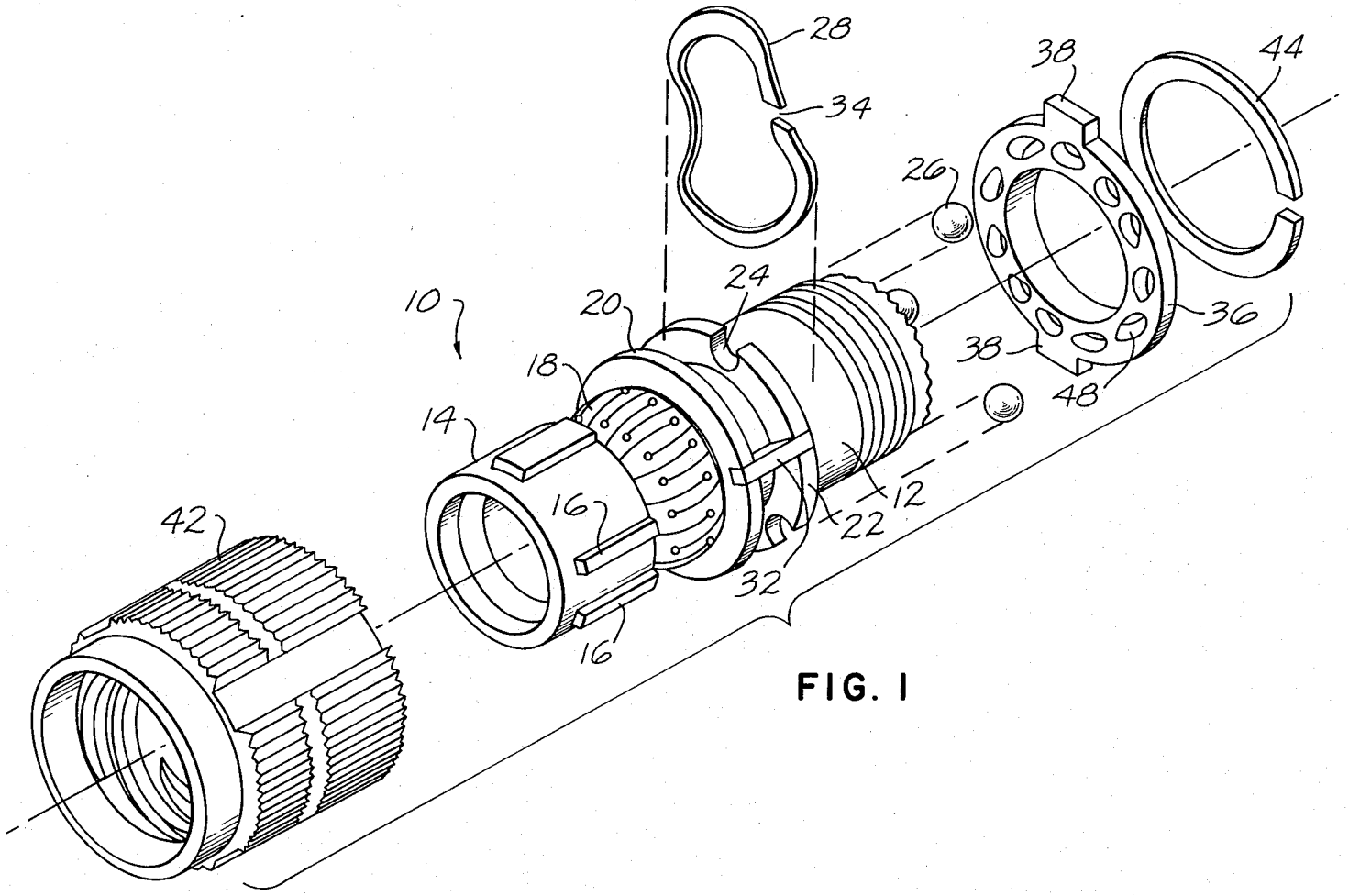
FIG. 1 is an exploded, perspective view of a plug connector member embodying one form of the self-locking mechanism of the present invention which utilizes three detent balls.
Figure 2:
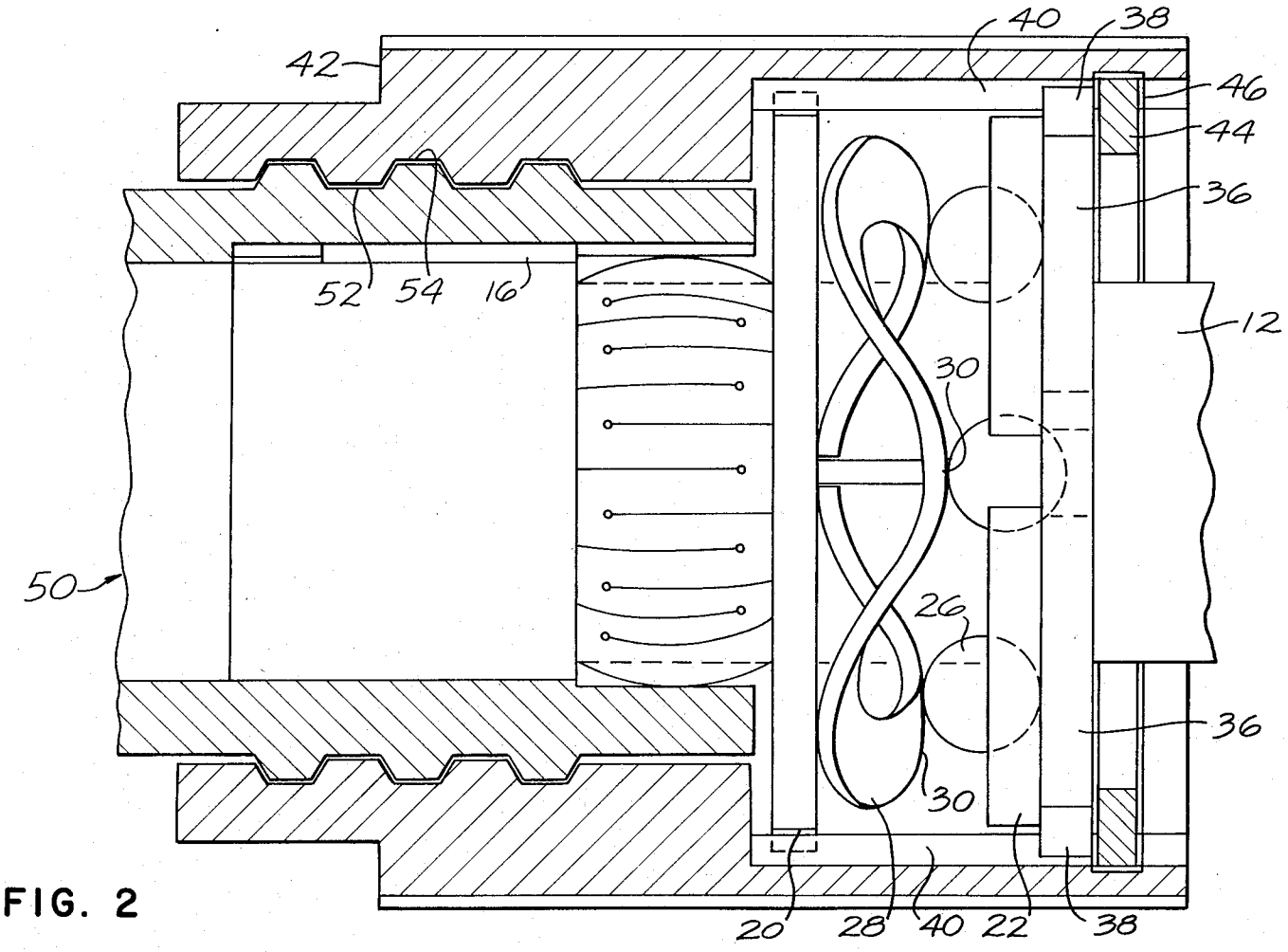
FIG. 2 is a fragmentary, partial sectional view of the plug connector member of FIG. 1 shown mated with a receptacle connector member.

Referring now to FIG. 1 of the drawings in detail, there is shown a plug connector member, generally designated 10, which may be utilized for either an electrical connector or an optical fiber connector. The plug connector member comprises a generally cylindrical barrel 12 formed at its forward end 14 with a plurality of circumferentially spaced polarizing keys 16 as is conventional in the connector art. Positioned behind the keys 16 is a RFI/EMI shield 18 which, as will be appreciated, may only be required for an electrical connector. A pair of axially spaced annular flanges 20 and 22 are formed on the barrel behind the shield 18. The flange 22 is formed with three equally spaced arcuate cavities 24, only two being visible in FIG. 1. Each of the cavities contains a detent ball 26. A wave spring 28 is positioned in the space between the flanges 20 and 22. As seen in FIG. 2, the spring is formed with three rearwardly facing crests 30 which are equally spaced from each other and aligned in front of the balls 26. The proper orientation of the crests on the spring relative to the balls is achieved by a key 32 extending between the flanges 20 and 22 and lying in the gap 34 formed in the spring.

The locking ring 36 of the locking mechanism surrounds the barrel behind the flange 22. The ring embodies a pair of outwardly extending tabs 38 which fit within axially extending key slots 40 formed in the inner surface of the coupling nut 42 that surrounds the barrel 12. A retaining ring 44 mounted in an annular groove 46 in the coupling nut retains the locking ring 36 and coupling nut on the barrel as best seen in FIG. 2. Detent recesses 48 are formed on the front face of the locking ring 36 facing in the direction of the balls 26. Preferably the recesses are pear shaped as shown with the tapered ends extending in the trailing direction when the coupling nut is rotated in the direction to couple the plug connector member to the mating receptacle connector member shell 50 shown in FIG. 2, typically in the clockwise direction as viewed from the rear of the plug connector member.

The matching threads 52 and 54 on the coupling nut 42 and receptacle shell 50, respectively, are shown as being of the Acme type. Typically only a 360° rotation of the coupling nut is required with the Acme thread to achieve full mating of the plug and receptacle connector members. However, the threads could be finer so that several rotations of the coupling nut and required to couple the connector members, or coarser so that less than 360° rotation is required.

Figure 3:
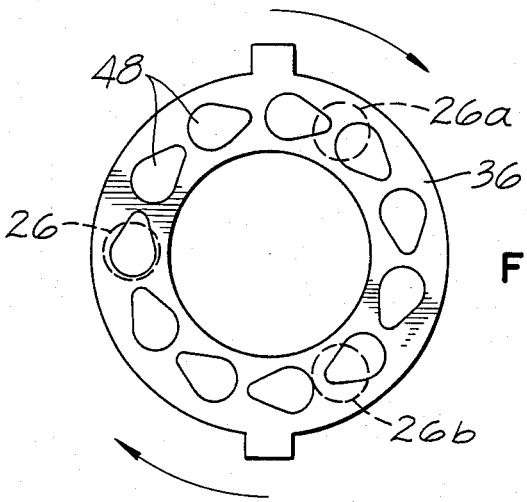
FIG. 3 is a front view of the locking ring utilized in the plug connector member illustrated in FIGS. 1 and 2, showing in dotted lines one position of the three detent balls with respect to the detent recesses formed in the ring.

When the plug and receptacle connector members are being mated by the rotation of the coupling nut 42, the locking ring is pressed against the balls 26 as coupling proceeds under increasing pressure due to the compression of the wave spring 28. During rotation of the coupling nut, the locking ring 36 will rotate with the nut, causing the balls 26 to engage the recesses 48 producing a ratcheting effect and self-locking of the connector members when the coupling nut 42 is fully threaded onto the receptacle shell 50. However, unlike the prior art self-locking mechanisms wherein the balls engage in detent recesses in unison, in accordance with the present invention the balls and recesses are arranged so that only one ball engages a recess at any instant so that finer angular articulation may be provided to create an effective lock even with the rapid threaded coupling system utilized in the connector. In the embodiment of the invention illustrated in FIGS. 1 and 3, the desired result is achieved by providing a number of detent recesses in the locking ring 36 which is indivisible by the number of balls 26. As shown, eleven detent recesses 48 are provided in the locking ring while three balls 26 are provided in the locking mechanism. The recesses 48 are spaced equally from each other around the face of the locking ring. Thus, as seen in FIG. 3, only one ball 26 engages a recess 48 in the locking ring. The other two balls indicated by reference numerals **26*a* and 26*b* in FIG. 3 engage the front face of the locking ring, and consequently do not lie in one of the recesses 48. For this arrangement, there are thirty-three detent points in 360° of rotation of the coupling nut. By way of further example, thirteen detent recesses 48 could be provided in the locking ring, with three balls 26**, in which case thirty-nine detent points would be provided in 360° of rotation of the coupling nut. This greatly increases the number of locking positions for the coupling nut utilized in the plug connector member of the present invention, in contrast to the four locking or detent points which are provided in a typical prior art coupling mechanism utilizing three balls and twelve detent recesses. It will, of course, be appreciated that the number of balls and recesses may be altered in order to increase or decrease the number of detent points provided that the number of recesses is not divisible by the number of balls.

It will be appreciated that the present invention could be applied to coupling mechanisms having different forms than those specifically disclosed in FIGS. 1 to 3. For example, there could be a larger number of balls than detent recesses in which case the number of balls would not be divisible by the number of recesses. Furthermore, the balls 26 and flange 22 could be replaced by a separate ring which is keyed to the plug barrel and formed with integral projections or dimples which would perform the same function as the balls. Alternatively, projections or dimples could be provided on a suitably shaped wave spring, thus eliminating the need for the spring 28. Thus, the term "detent projection" utilized in the claims appended hereto is intended to embrace not only balls but also dimples or projections formed on either rigid or spring rings. Further, the locking ring 36 could be fixed against rotation on the plug barrel 12 and the balls 26 carried by the coupling nut 42. The locking mechanism could also be arranged with the detent projections being carried by the coupling nut 42 engageable with detent recesses formed on the receptacle shell 50. The detent projections may operate either in the axial direction, as shown in the drawings, or in a radial direction.

Figure 4:
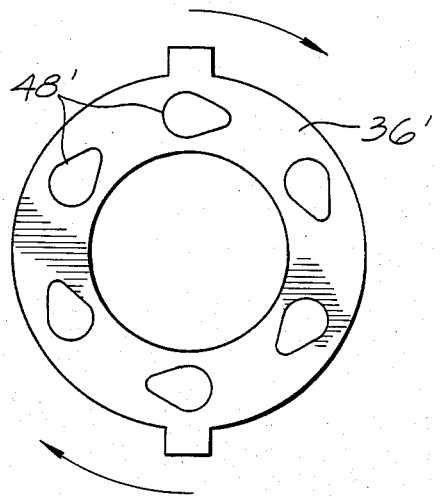
FIG. 4 is a front view of an alternative form of a locking ring which may be utilized in the connector of the present invention.
Figure 5:
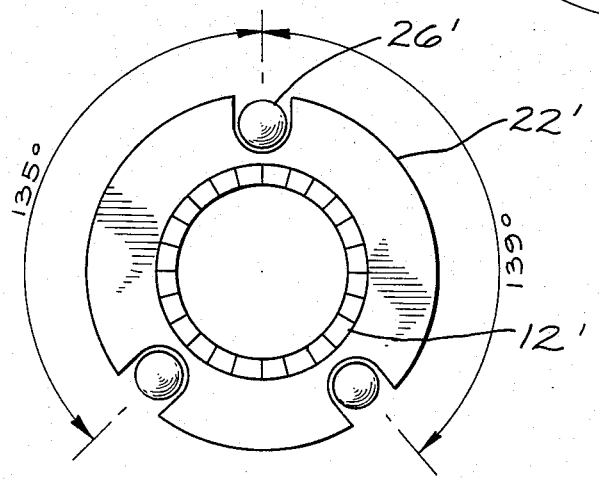
FIG. 5 is a rear view of a plug connector shell embodying detent balls which may be utilized with the locking ring illustrated in FIG. 4.

Reference is now made to FIGS. 4 and 5 of the drawings which show, respectively, a locking ring 36' and detent balls 26' mounted on a flange 22' of a barrel 12' in a manner similar to that illustrated in FIGS. 1 to 3, except that the number of recesses 48' is divisible by the number of balls 26'. The recesses 48' are spaced equally around the surface of the ring 36' but the balls 26' are not equally spaced from each other. The balls are spaced in such a fashion that only one engages a recess 48' at any instant. In the arrangement shown, one of the balls 26' is spaced at an angle of 135° from a second ball, and the third ball is spaced 139° from the second ball in the opposite direction. In contrast to the locking arrangement illustrated in FIGS. 1 to 3, in this arrangement the locking or detenting action in which a ball snaps into a detent recess will not be uniform because the balls are not equally spaced from each other. In the embodment illustrated in FIGS. 4 and 5, the number of detent recesses and balls could be increased provided that the recesses and balls are arranged in such a circular pattern that only one ball engages a recess at one instant during rotation of the coupling nut.

What is claimed is:

1. A plug connector member adapted to mate with a receptacle connector member comprising:

a barrel having a coupling ring rotatable thereon;

locking means operative between said coupling ring and said barrel to prevent relative rotation thereof;

said locking means comprising an annular element having a plurality of circumferentially spaced detent recesses therein and a locking element having a plurality of detent projections thereon facing said recesses;

one of said elements being fixed against rotation on said barrel and the other element being rotatable with said coupling ring;

means biasing said projections and recesses toward each other; and said recesses and projections being arranged whereby only one projection may engage a recess at any given relative position of said annular and locking elements so that a large number of locking positions is provided.

2. A plug connector member as set forth in claim 1 wherein:

the number of said recesses exceeds the number of said projections and is indivisible by said number of projections.

3. A plug connector member as set forth in claim 2 wherein:

said recesses are equally spaced around said annular element; and said projections are equally spaced around said locking element.

4. A plug connector member as set forth in claim 1 wherein:

said coupling ring embodies coupling means capable of fully mating said connector members with no more than about 360° of rotation of the ring.

5. A self-locking connector comprising:

a plug connector member and a mating receptable connector member each having a connector shell;

a coupling ring rotatable on one of said shells;

locking means operative between said coupling ring and one of said shells to prevent relative rotation thereof;

said locking means comprising an annular element having a plurality of circumferentially spaced detent recesses therein and a locking element having a plurality of detent projections thereon facing said recesses;

one of said elements being fixed against rotation relative to said shells and the other element being rotatable with said coupling ring;

means biasing said projections and recesses toward each other; and said recesses and projections being arranged whereby only one projection may engage a recess at any given relative position of said annular and locking elements so that a large number of locking positions are provided.

6. A connector as set forth in claim 5 wherein:

the number of said recesses exceeds the number of said projections and is indivisible by said number of projections.

7. A plug connector member adapted to mate with a receptable connector member comprising:

a barrel element having a coupling ring element rotatable thereon;

locking means operative between said coupling ring element and said barrel element to prevent relative rotation thereof;

said locking means comprising a coaxial array of circumferentially spaced detent recesses carried by one of said elements and a plurality of detent projections carried by the other of said elements and extending toward said recesses;

means biasing said projections towards said recesses; and said recesses and projections being arranged whereby only one projection may engage a recess at any given relative position of said annular and locking elements so that a large number of locking positions is provided.

8. A plug connector member as set forth in claim 7 wherein:

the number of said recesses exceeds the number of said projections and is indivisible by said number of projections.

* * * * *